US005887364A

United States Patent [19]

Toth

[11] Patent Number: 5,887,364

[45] Date of Patent: Mar. 30, 1999

[54] SNOW REMOVAL ATTACHMENT FOR A RAKE

[76] Inventor: Julius A. Toth, 6515 Haggerty Rd., Belleville, Mich. 48111

[21] Appl. No.: 985,026

[22] Filed: Dec. 4, 1997

Related U.S. Application Data

[60] Provisional application No. 60/032,335 Dec. 4, 1996.

[51] Int. Cl.[6] ..... E01H 5/06; E01H 5/02; E02F 3/76

[52] U.S. Cl. ..... 37/266; 37/903; 37/407; 37/285

[58] Field of Search ..... 37/285, 284, 278, 37/266, 241, 403, 407, 903; 172/371; 56/400.05, 400.07, 400.19

[56] References Cited

U.S. PATENT DOCUMENTS

| | | | |
|---|---|---|---|
| D. 291,611 | 8/1987 | Toth . | |
| 1,093,535 | 4/1914 | Civita et al. | 56/400.05 |
| 2,114,394 | 4/1938 | Lines | 56/400.06 |
| 2,114,518 | 4/1938 | Bayliss | 56/400.05 |
| 2,597,767 | 5/1952 | Williams | 56/400.04 |
| 2,637,261 | 5/1953 | Wale | 56/400.06 |
| 3,091,790 | 6/1963 | Schroeder . | |
| 3,397,469 | 8/1968 | Browning | 37/241 X |
| 3,691,743 | 9/1972 | Browning | 56/400.05 |
| 3,804,451 | 4/1974 | Burke | 37/285 |
| 4,173,835 | 11/1979 | Burrell | 37/285 |
| 4,386,474 | 6/1983 | Mechavich et al. . | |
| 4,597,204 | 7/1986 | Heiden . | |
| 4,948,188 | 8/1990 | Haslam | 37/285 X |
| 5,271,169 | 12/1993 | Konsztowicz . | |
| 5,309,654 | 5/1994 | Mathis . | |
| 5,440,828 | 8/1995 | Simpson . | |
| 5,465,510 | 11/1995 | Goodnough et al. . | |

*Primary Examiner*—Thomas B. Will
*Assistant Examiner*—Gary S. Harjmann
*Attorney, Agent, or Firm*—Gifford, Krass, Groh, Sprinkle, Anderson & Citkowski, P.C.

[57] ABSTRACT

A snow removal assembly for clearing an area. The assembly consists of a rake having a rake frame attached to the lower end of a rake handle and a snow moving member preferably formed of an elongated plate extending between the rake frame. The elongated plate also includes cutouts on either side of the plate for securing the plate to the rake frame on one side of the rake teeth. A bar is provided for bracing the plate to the rake. The bar is placed opposite the plate and has the rake teeth disposed between the bar and the plate. Screws are provided for attaching the bar through the rake teeth to the plate on the opposite side. The rake head with plate can be used to lift and remove snow from the area.

10 Claims, 1 Drawing Sheet

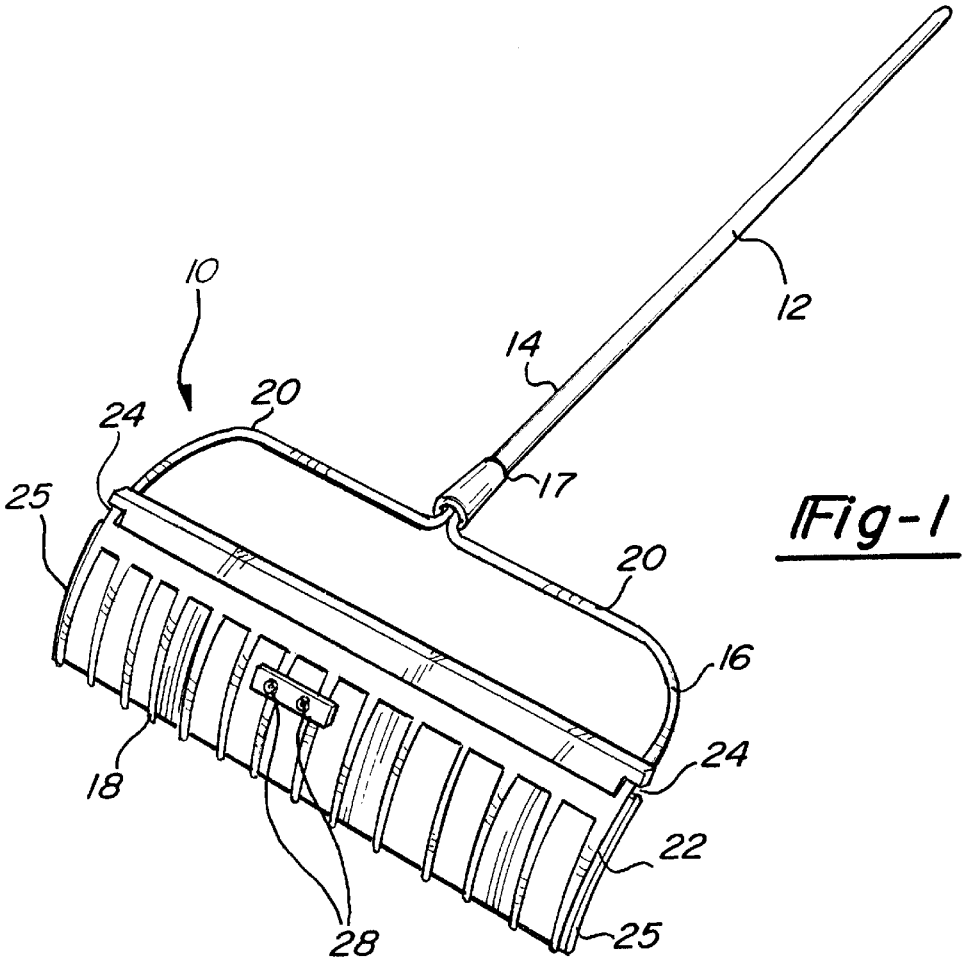
Fig-1
Fig-2
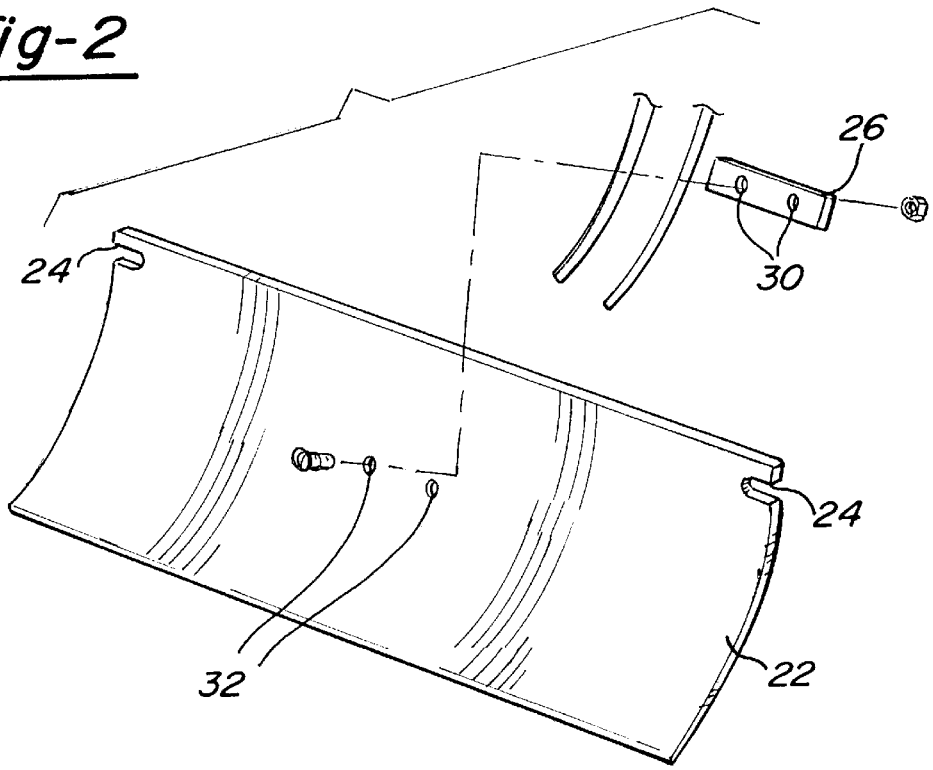

SNOW REMOVAL ATTACHMENT FOR A RAKE

This application claims benefits of Provisional Application 60,032,335 filed Dec. 4, 1996.

BACKGROUND OF THE INVENTION

1. Field of the Invention

The present invention relates generally to snow moving devices, and more particularly to a snow moving device that may be attached to a rake. The snow moving device permits snow to be pulled from a surface area while requiring no bending or lifting by the user.

2. Description of the Relevant Art

Removing snow from areas such as driveways and walkways by shoveling places a strain on a user's back, heart and legs. While snow removal machines permit users to avoid much of the strain associated with shoveling, these machines are often expensive and difficult to maintain. There remains a need for a simple, inexpensive and easy way to move snow.

SUMMARY OF THE INVENTION

The present invention provides a snow moving device that is simple, inexpensive and eases any strain that may be experienced by a user when removing snow and ice from an area such as a driveway.

The present invention provides a snow removal assembly that includes a rake head having several rake teeth extending along a rake frame. The rake frame the outer profile of the rake head. The handle supported by the rake head extends upward and away from the rake head.

A snow removal member such as a plate is provided for removing snow from an area. The plate is attached to the rake head by a brace such as a bar. The plate extends along the horizontal axis of the rake head on one side while the bracing bar extends along the horizontal axis of the rake head on the opposite side enclosing the rake teeth in between the two.

At least two holes are provided along the horizontal axis of the plate for correspondence with two holes provided along a horizontal axis of the bar. Locking means such as screws or bolts are slipped through the holes in the bar past the rake teeth and into the corresponding holes provided in the plate. In this way, the plate is braced to the rake head and secured in position for use by the consumer.

Multiple braces may be provided as needed depending upon the size of the plate and rack head. Further, the plate may be provided with a parabolic shape having a curved at the base of the plate for aiding the consumer in scooping up snow out of the area.

The rake with snow moving plate assembly may be used to lift and remove the snow from the area.

The present invention provides the consumer with an inexpensive yet easily maintainable snow removal system.

BRIEF DESCRIPTION OF THE DRAWINGS

The present invention will be more fully understood by reference to the following detailed description of the preferred embodiments of the present invention when read in conjunction with the accompanying drawings, in which like reference numerals refer to like elements throughout the views, and in which:

FIG. 1 is a perspective view showing a preferred embodiment of the snow removal assembly of the present invention; and FIG. 2 is an enlarged top view showing the bracing members used to attach the snow removal member to the rake head of the present invention.

DESCRIPTION OF THE PREFERRED EMBODIMENT

With reference first to FIG. 1, the snow removal assembly of the present invention is generally shown at 10. The assembly includes a rake 12 having a handle 14. A rake frame 16 is attached to the lower end 17 of rake handle 14 and includes a plurality of rake teeth 18. Rake frame 16 also preferably includes two arms 20 on either side of rake teeth 18 for connecting rake teeth 18 to the handle 14 at its lower end 17. Rake frame 16 the outer profile of the rake 12.

A snow removal member preferably in the form of an elongated plate 22 is attached to the rake frame 16 so as to position plate 22 near the rake teeth 18. In the first preferred embodiment shown in FIG. 1, plate 22 includes two cutouts 24. Cutouts 24 are preferably positioned opposite each other on each end 25 along the horizontal axis of plate 22.

Plate 22 may be flexed during installation so that rail arms 20 may be positioned within cutouts 24 for securing plate 22 to rake frame 16.

With reference to FIG. 2, additional securing means such as a securing bar 26 is positioned so that rake teeth 18 are disposed between securing bar 26 and plate 22. Screws or bolts 28 may be threaded through holes 30 provided in securing bar 26 and corresponding holes 32 provided in plate 22 to secure plate 22 and bar 26 in a fixed position. A second securing bar 26 may be positioned between the rake teeth 16 and plate 22 to provide additional stability to plate 22. While this provides a simple, economical means to connect plate 22 to rake 12, other methods may be used.

For flexibility in securing plate 22 with cutouts 24 about rake frame 16, plate 22 is preferably made of plastic, although other materials such as ceramics may be used. In a preferred embodiment, plate 22 may be flat as shown in FIG. 1 or, as shown in FIG. 2 provided with a curve at one end for aiding in scooping snow. Additionally, plate 22 may be fixed to the rake frame 16 in a curved position by adjusting the bracing angle of the securing bar to the plate. Further, the plate 22 may be attached to rake 12 in a flat position by again adjusting the bracing position of bar 26 to plate 22.

After the snow removal assembly has been successfully secured to the rake handle, assembly may be used to lift and remove the snow from the desired area.

The above described snow removal assembly provides a simple, inexpensive and easy way to remove snow while minimalizing the strain on the user's back, heart and lungs.

Having described my invention, however, many modifications will become apparent to those skilled in the art. These and other changes are within the spirit of the invention as defmed by the scope of the appended claims.

I claim:

1. A snow removal attachment assembly comprising in combination a rake and a snow moving member;

said rake comprising a rake frame attached to the lower end of a rake handle;

said rake frame including a plurality of rake teeth extending downwardly from said rake handle and having arms on either side of said rake teeth for connecting said rake teeth to said handle;

said snow moving member comprising an elongated plate extending between said rake frame and having means for securing said snow moving member to said rake;

said means for securing said snow moving member to said rake comprising a pair of cutouts on opposing edges of each side of said plate for securing said plate to said arms on said sides of said rake teeth and above said rake; and a first bar separate from said plate and extending parallel to and opposite said plate; said first bar and said plate each having two, matching and opposing openings for securing said plate to said rake and having said rake teeth disposed between said first bar and said plate whereby said rake teeth and said pair of cutouts align said plate along said rake frame and said first bar secures said plate to said rake.

2. The snow removal attachment assembly as defined in claim 1, wherein said plate is secured to said rake at an angle to said rake.

3. The snow removal attachment assembly as defined in claim 1, wherein said plate is secured to said rake parallel to and aligned with said rake.

4. The snow removal assembly as defined in claim 1 wherein said snow moving member is formed of a polymerized material.

5. A snow removal assembly for clearing an area comprising:

a rake head having a plurality of rake teeth extending along a rake frame, said rake frame defining the outer profile of said rake head;

a handle supported by said rake head and extending upwardly from said rake head;

a snow removal member supported by said rake head;

means for bracing said snow removal member to said rake head;

wherein said snow removal member is used to lift and remove said snow from said area;

said snow removal member comprising an elongated plate having a pair of cutouts on opposing edges of each side of said plate for securing said plate to said rake frame;

said means for bracing said snow removal member to said rake head comprising a first bar extending bar extending parallel to and opposite said plate; said first bar and said plate each having two, matching and opposing openings for securing said plate to said rake and having said rake teeth disposed between said first bar and said plate whereby said rake teeth and said pair of cutouts align said plate along said rake frame and said first bar secures said plate to said rake.

6. The snow removal assembly as defined in claim 5, said snow removal member comprising a curved plate.

7. The snow removal assembly as defined in claim 5, said curved plate further comprising cutouts on either side of said plate for securing said plate to said rake frame.

8. The snow removal assembly as defined in claim 5, wherein said snow removal member is secured to said rake head at an angle to said rake head.

9. The snow removal assembly as defined in claim 5, wherein said snow removal member is secured to said rake head parallel to and aligned with said rake head.

10. The snow removal assembly as defined in claim 5 wherein said snow removal member is formed of a polymerized material.

* * * * *

UNITED STATES PATENT AND TRADEMARK OFFICE

CERTIFICATE OF CORRECTION

PATENT NO. : 5,887,364

DATED : March 30, 1999

INVENTOR(S) : Julius A. Toth

It is certified that error appears in the above-identified patent and that said Letters Patent is hereby corrected as shown below:

Column 1, line 49 - Replace "rack" with -- rake --.
Column 1, line 50 - Replace "curved" with --curve--.
Column 2, line 46 - Insert --the-- before the word "assembly".
Column 2, line 46 - Insert --10-- after the word "assembly".
Column 4, line 7 - Delete "bar extending" (second occurrence).

Signed and Sealed this

Fourth Day of July, 2000

*Attest:*

Q. TODD DICKINSON

*Attesting Officer*

*Director of Patents and Trademarks*